US006152450A

United States Patent [19]

Boudreaux et al.

[11] Patent Number: 6,152,450

[45] Date of Patent: Nov. 28, 2000

[54] WAGERING GAME SYSTEM AND METHOD

[76] Inventors: Ernest Thompson Boudreaux; Marc Hoesel, both of 121 Forest Star Dr., Golden, Colo. 80403; Brian O'Donnel, 3405 Luckie Rd., Cheyenne, Wyo. 82001

[21] Appl. No.: 09/157,874

[22] Filed: Sep. 21, 1998

[51] Int. Cl.[7] ..... A63F 1/00

[52] U.S. Cl. ..... 273/292; 273/298

[58] Field of Search ..... 273/298, 256, 273/244, 292, 274; 463/17

[56] References Cited

U.S. PATENT DOCUMENTS

| | | | |
|---|---|---|---|
| 3,854,720 | 12/1974 | Duvall | 273/89 |
| 3,957,269 | 5/1976 | Bouchard | 273/93 |
| 4,659,087 | 4/1987 | Shen et al. | 273/274 |
| 5,393,067 | 2/1995 | Paulsen et al. | 273/309 |
| 5,417,430 | 5/1995 | Breeding | 273/274 |
| 5,435,567 | 7/1995 | Compres | 273/244 |
| 5,593,161 | 1/1997 | Boylan et al. | 273/292 |
| 5,605,333 | 2/1997 | Field | 273/274 |
| 5,649,705 | 7/1997 | String | 273/274 |
| 5,868,392 | 2/1999 | Kraft | 273/292 |
| 5,882,009 | 3/1999 | Schaefer | 273/292 |
| 5,901,958 | 5/1999 | Andrews | 273/292 |
| 5,921,550 | 7/1999 | Awada | 273/292 |
| 5,944,314 | 8/1999 | Stavinsky | 273/292 |
| 6,007,427 | 12/1999 | Wiener et al. | 463/17 |

FOREIGN PATENT DOCUMENTS

| | | | |
|---|---|---|---|
| WO 94/19074 | 9/1994 | WIPO | 273/292 |

*Primary Examiner*—Jeanette Chapman
*Assistant Examiner*—Dolores R. Collins
*Attorney, Agent, or Firm*—Ramon L. Pizarro; Edwin H. Crabtree

[57] ABSTRACT

A banking type wagering game for play between several players, an object of the game being player advancement along a sequence of locations or bases, the game being conducted by a single dealer. The game includes a dealer position, at least three player positions, each having a series of sequential base positions. A set of distinctive buttons or markers are used for marking the sequential base advancement of the player at that player position. Additionally, at least one distinctively marked placing a bet is included between the dealer position and each of the player positions, so that the dealer and a remote camera can monitor a game amongst several players.

14 Claims, 4 Drawing Sheets

WAGERING GAME SYSTEM AND METHOD

BACKGROUND OF THE INVENTION (a) Field of the Invention

This invention generally relates to a gaming system and method, and more particularly, but not by way of limitation, to a wagering game that includes a baseball theme and which has been adapted for institutionalized gambling.

(b) Discussion of Known Art

The American affinity for the sport of Baseball has made the principles and objects of the game to become well known throughout many parts of the world. These principles include that a player must hit a ball thrown at the player by a pitcher, that the player must hit the ball with sufficient force and control to drive the ball to a position on the playing field where players on the opposing team cannot catch the ball, allowing the player to run to the next available base. The familiarity of the game offers provides a vehicle for teaching, learning, practice and enjoyment of other endeavors if these endeavors can be formatted to mimic the game of baseball. Accordingly entrepreneurs and the like have tried to develop games which can present participants with rules and structure that mimics the principles and objects of baseball to allow players learn the game quickly, due to the association of the game with the principles of baseball, and to enjoy playing the game, to the its similarities with the experience of playing baseball. Particularly, many have tried to provide games that carry a colorable similarity to baseball, but really do not present similarities in the experience and goals of the game. For example, the game taught in U.S. Pat. No. 5,593,161 to Boylan et al. teaches a wagering game which allows players to place bets in two locations, in one embodiment, one wagering location has the appearance of a base and the other wagering location has the appearance of the home base found on a baseball diamond. In this game, however, the similarities to baseball end with the appearance of the indicia used for guiding players as to where to place their bets.

Yet other examples of a game which use a baseball theme include U.S. Pat. No. 2,347,506 to Riehle which teaches a game consisting of a board game with concentric baseball diamonds. U.S. Pat. No. 1,259,987 to Huff et al., which teaches a baseball board game in which uses cards to designate the different plays carried out in the field. Similarly, U.S. Pat. Nos. 840,584 (Piper), 1,170,821 (Keller), 1,177,677 (Beam), 2,283,578 (Rogers et al.), and 2,812,181 (Richman) are board type games with baseball themes.

A review of the above patents will reveal that there remains a need for a wagering game which allows players to compete with an "opposer", such as a pitcher, to try to obtain a "hit" which will allow the player to advance bases. Importantly, there remains a need for a device or system that allows the many players to participate and wager, while allowing a governing player, such as a dealer who represents the casino, to monitor and participate in the gambling process.

SUMMARY

It has been discovered that the problems left unanswered by known art can be solved by providing a game and system which includes:

a dealer position; and at least two player positions having:

means for allowing and marking the advancement of the player at that position; and at least one means for placing a bet, the means for placing a bet being positioned between the dealer position and the player position.

In a highly preferred embodiment of the invention, the means for marking the advancement of a player are positioned in a baseball diamond shaped arrangement, where each corner of the diamond represents a base. Additionally, the means for placing a bet will preferably include a pair of distinctive locations for placing bets. In a preferred embodiment, one of the positions for placing a bet will include a position which is designated as an ante position, and the other position will be designated as a strike-out wager position.

The dealer position will preferably be placed opposite to the player positions, and most preferably, at a central position with the player positions falling within an included angle of less than 240, and most preferably less than 180 degrees. With this arrangement, a dealer working at the dealer position will be able to observe, either directly or by peripheral vision, each of the player positions. Additionally, this arrangement allows the positioning of a single surveillance camera over the dealer position, allowing the constant remote monitoring of the activities during the game.

Furthermore, it is important to note that the disclosed arrangement and game components lend themselves for clear surveillance, while providing an economically viable gaming system that is intuitive to learn. Accordingly, it is contemplated that each of the player positions be separated by a well defined line that allows viewing of when a player is trying to reach into his neighbors position to take gambling chips or disturb the means for marking the advancement of a player. Additionally, by positioning the means for placing a bet between the diamond with the means for marking the advancement of the position of the players and the dealer, one achieves a game that takes up little room on the casino floor and allows monitoring of the bet placement and the advancement of the players around the baseball diamond.

According to a highly preferred embodiment of the invention, a game of baseball with wagering may be played with a 52 card deck of cards. In this method, the dealer monitors and controls the play as the players compete amongst themselves. To begin the game the players place their bets on the ante and on the "strike-out" positions, which are means for placing a bet. It should be noted that while it is contemplated that the means for placing a bet may comprise a marked off area on the playing surface, it is also contemplated that these means may include electronically actuatable components. For example, it is contemplated that a credit system may be employed in conjunction with a data storage means and a processor means to allow a player to place the ante and strike out bets electronically.

According to one method for playing "baseball", or what will be referred to herein as "grand slam baseball", the players place their ante and strikeout bets. The game is played in innings, which are made up of plays. To start the game the dealer distributes a hand of five cards to each of the players. The five cards are used to play an entire inning. The playing of one card per player in a turn is referred to herein as a "play", therefore, each inning will comprise five plays.

Electronically, each player position could comprise of a display screen with a position indicator and a bet placement means, using electronically (digitally) monitored credit described above, and a hand may also be distributed electronically, keeping the odds of the 52 card deck as part of the electronically controlled parameters. The value of each of these cards is kept secret by the players. Once each player has been dealt a hand of five cards, the dealer then deals a card face up. This card establishes the trump suit which will be followed during the play. The first player to play a card, referred to herein as the "lead-off" player, lays down or plays a card of his choice. The next player must then beat this card by playing a higher card, preferably of the same suit. If the next player does not have a higher card of the same suit, he may then play a trump card of the trump suit established by the dealer. After each player has had a chance to play a card, the player who laid down the highest card of the suit or trump suit being played wins that play and is allowed to advance a base. In a preferred embodiment of the invention the advancement is carried out by means of a base-runner, or marker, which is used by the player to mark the base which he is at. Players who are not able to beat the outstanding card is said to strike-out, and lose the bet placed in the "strike out" means for placing a bet.

The ante is placed and collected at the beginning of each inning. The winner of the inning, who is clearly ahead of the other players as far as base position is declared the winner and awarded the ante bets, or pot.

With the disclosed invention, it is contemplated that the casino will collect the antes and strikeout bets and withdraw a "rake" sum for the casino from these sums. As an incentive to keep players participating in the game, it is also contemplated that a "progressive" bounty may be set aside from the sums collected as antes and strikeouts. This progressive sum is simply a percentage of the sums collected, and is accumulated throughout the game. Any player who "shuts out" the other players by being the only one who achieves a run for an inning or achieves a predetermined hand or play, is awarded the sums accumulated as the progressive bounty.

According to another method of play, described in greater detail in the following detailed description, allows playing of the disclosed baseball game while dealing only two cards to each player. This method may also be played with a progressive bounty.

It should also be understood that while the above and other advantages and results of the present invention will become apparent to those skilled in the art from the following detailed description and accompanying drawings, showing the contemplated novel construction, combinations and elements as herein described, and more particularly defined by the appended claims. It should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
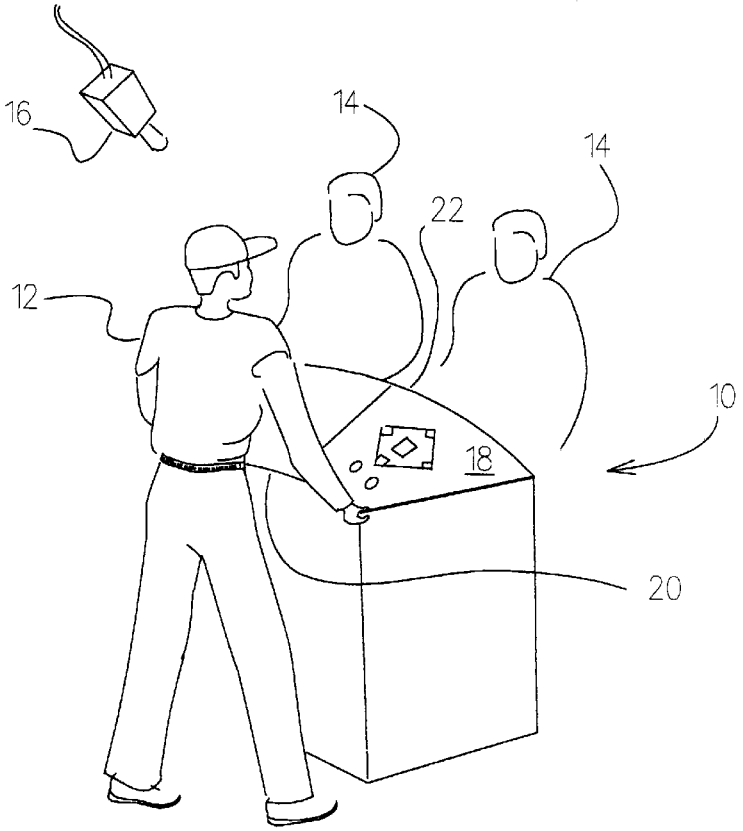
FIG. 1 is a perspective view of the invention in use.

Turning now to FIG. 1 where a wagering game 10 made in accordance with the principles taught herein is shown in use in a gaming setting. The wagering game 10 is being coordinated by a single dealer 12, who will typically be a casino employee who monitors and facilitates the game as it is played by several players 14. It is important to note that an important object of the instant invention is the ability to monitor the activates of the players 14 and the dealer 12. Towards this end, FIG. 1 illustrates that the wagering game 10 device can be monitored by a single camera 16, which verifies and supplements the monitoring efforts of the dealer 12.

Figure 2:
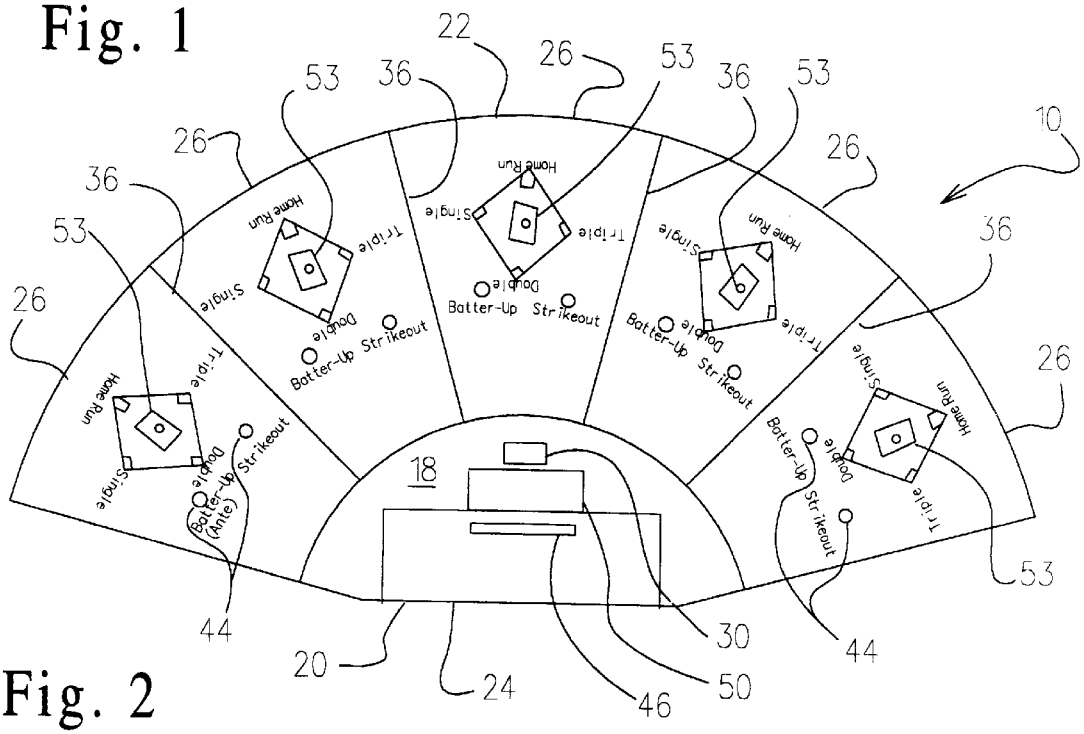
FIG. 2 is a top, plan view of a highly preferred embodiment of the invention.

Turning now to FIG. 2 where it has been illustrated that a highly preferred embodiment of the invention includes a surface 18 with a pair of opposing sides 20 and 22. On one side, labeled side 20 is a dealer position 24. On the opposing side, labeled side 22 are several player positions 26. In a highly preferred embodiment of the invention at least two player positions have been incorporated into the surface 18.

Figure 3:
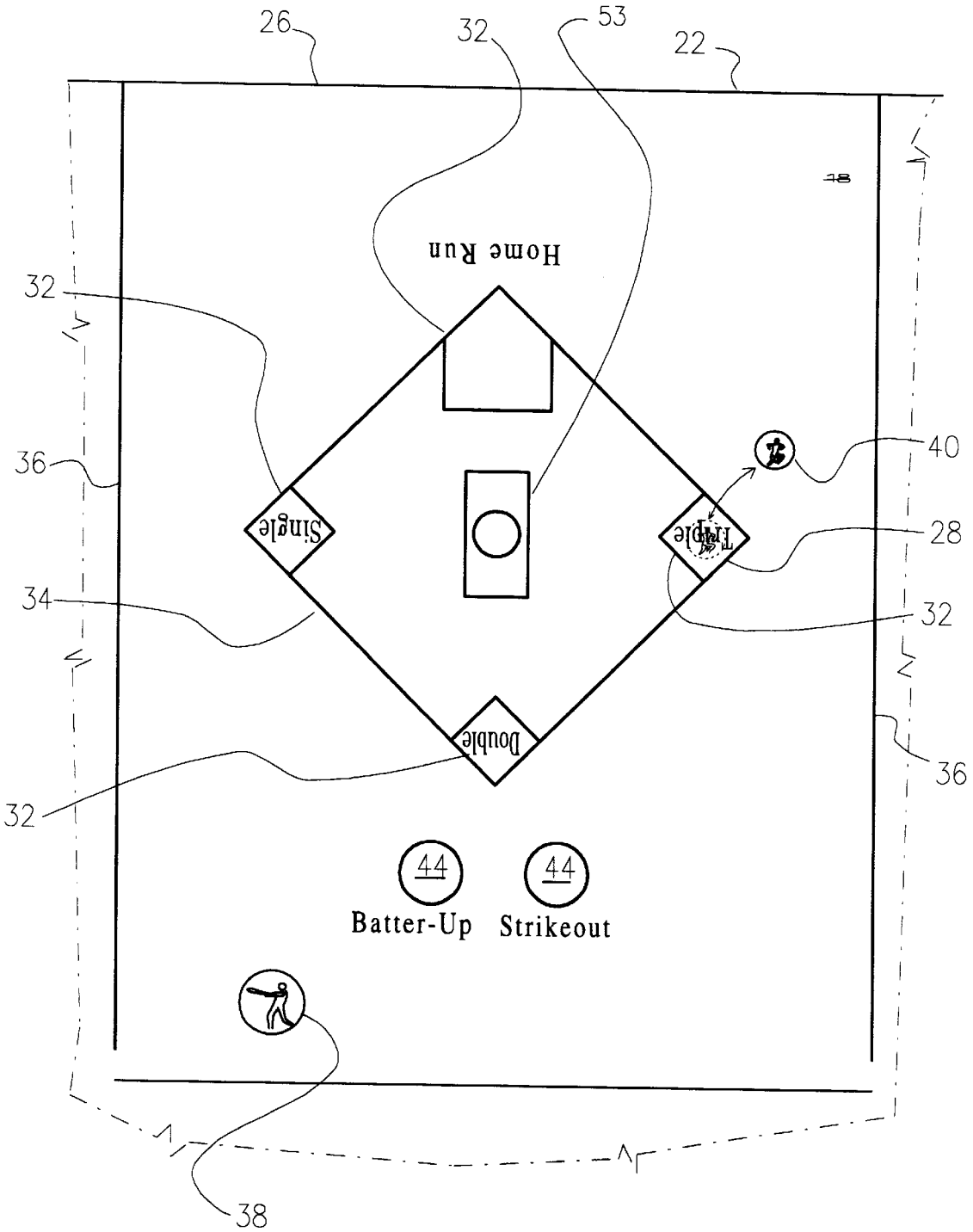
FIG. 3 is a top, plan view of a highly preferred embodiment of a player position to be used with the invention.

Referring now to FIG. 3 it will be understood that in a highly preferred embodiment of the invention the player positions 26 include means 28 for following and marking the advancement of the player at that player position. It is contemplated that these means for following and marking the advancement of the player at the player position will include series of bases 32 arranged in a baseball diamond configuration 34. The bases 32 will be used in conjunction with a marker or base-runner button 40 which represents the position of the player or runner along the bases 32.

Also shown on FIG. 3 is that the player position 26 also includes at least one means 44 for placing a bet or wager. In a highly preferred embodiment of the invention the means 44 for placing a bet will be positioned between the dealer position 24 and the player position 26. This arrangement allows monitoring of the placement of bets with the camera 16.

FIG. 3 is a top, plan view of a highly preferred embodiment of a player position 26 to be used with the invention. The player position will preferably include contrasting indicia 36 which will extend between the player positions 26 to accentuate the crossing of a player's arm or artifact into the adjacent player position. The illustrated contrasting indicia 36 includes a pair of substantially parallel lines; however, referring to FIG. 2 it will be understood that in a highly preferred embodiment of the invention the contrasting indicia 36 will be positioned in a substantially radial arrangement to one another.

Another important feature that is situated near the player position illustrated in FIG. 3 is a pair of means for placing a bet which comprises a pair of bounded areas 44 bounded by contrasting indicia in a generally circular shape. It is important to note that while in the preferred embodiment of the invention these bounded areas 44 are shown as circular or round contrasting indicia, it is contemplated that these means for placing a bet may include electronically connected switches that debit a credit card or other similar means for keeping track of sums. These bounded areas will preferably be positioned between the player position 26 and the dealer position 24. The position of these bounded areas allows monitoring by the camera 16 and the dealer 12 of wagers placed within the bounded areas 44. Additionally, the arrangement of the player position 26, the bounded area 44, and the dealer position 24 allows clear monitoring of the entire player surface with a single camera.

Figure 4:
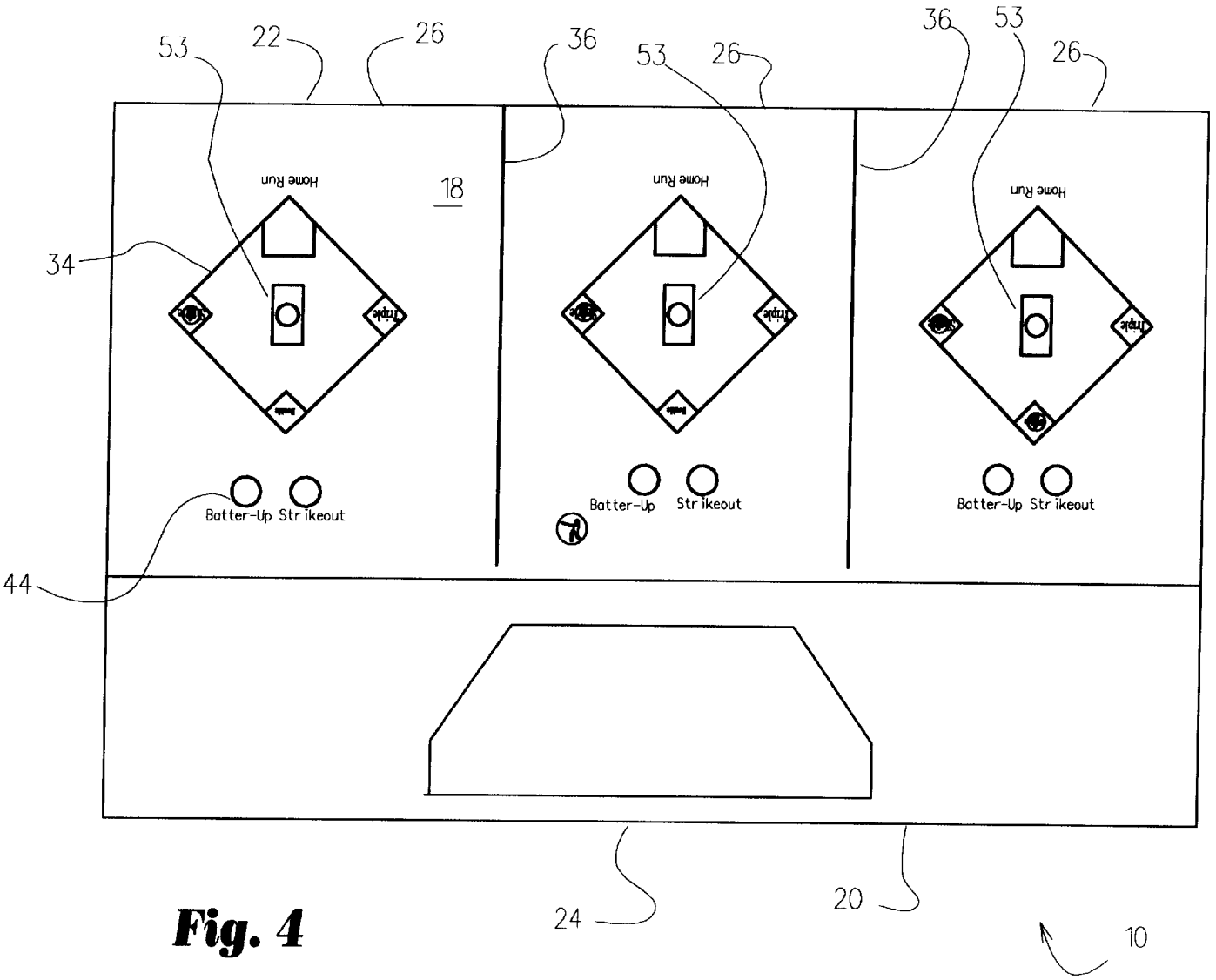
FIG. 4 is a plan view of another embodiment of the invention.

Shown in FIG. 4 is a plan view of another embodiment of the invention. In this embodiment the player positions 26, as well as the contrasting indicia 36, are positioned in a generally parallel arrangement relative to one another. The position of the dealer position 24 relative to the player positions 26 is still on opposing sides of the surface on which the game is played.

Figure 5:
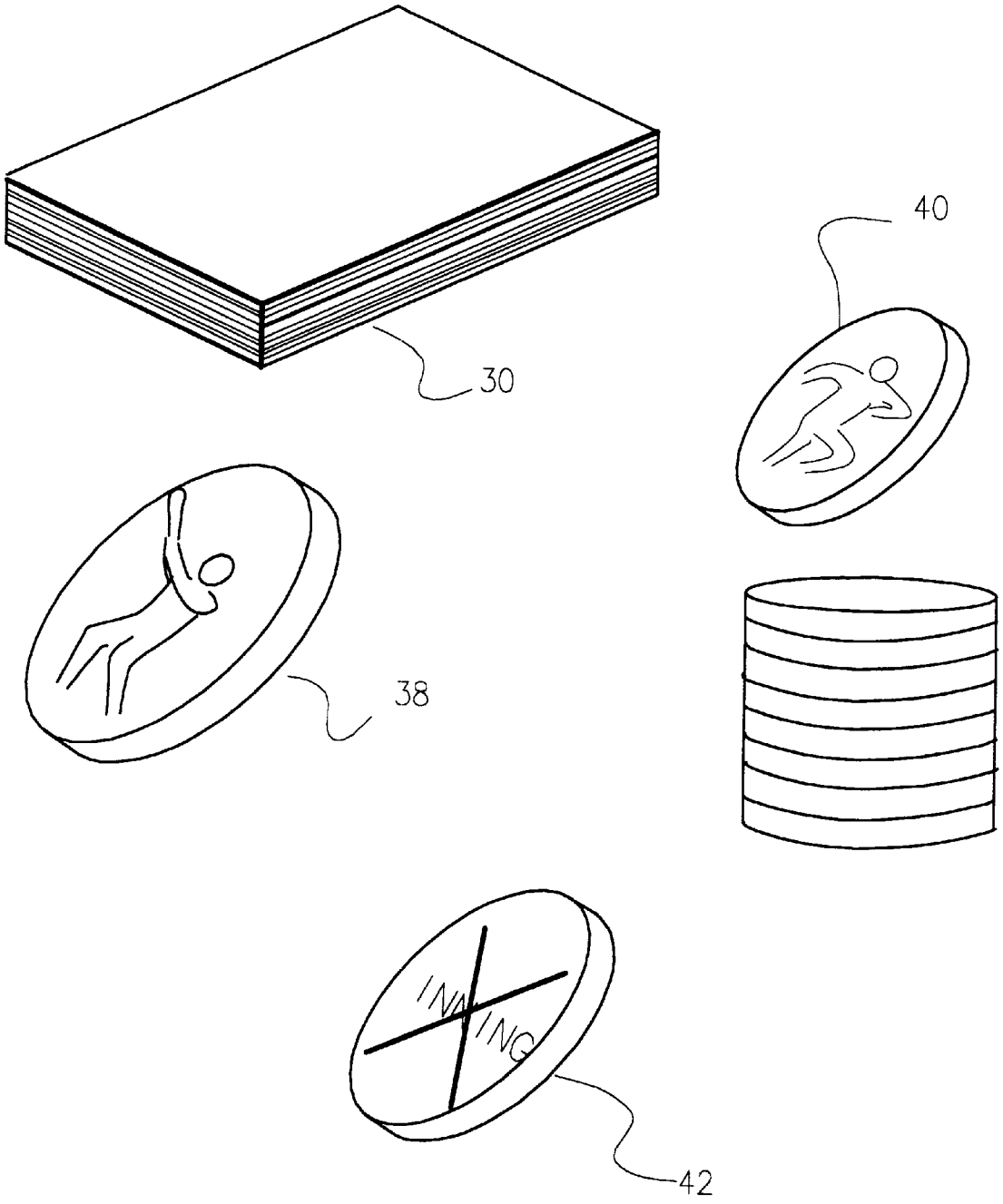
FIG. 5 illustrates pieces to be used with a highly preferred embodiment of the invention.

FIG. 5 illustrates pieces to be used with a highly preferred embodiment of the invention. These pieces include a marker, icon, chip, or button used to designate the starting player, referred to herein as a lead-off button 38. Additionally, a marker, icon, chip, or button referred to herein as a base-runner button 40 serves as a means for indicating the base position of each player on the respective diamond at each player position and is used to designate the player who beats the other players to earn a run from one base 32 to the next succeeding base 32, for example from the "single" position to the "double" position illustrated in FIG. 2. In a preferred embodiment of the invention the advancement from one base 32 to the next will require that the dealer 12 award a winning player a base-runner button 40, so that a runner on second base or on the "double" position will have two base-runner buttons 40. This minimizes the possibility of cheating by simply moving the chip or marker from one base to another when the dealer is not looking. Additionally, it is preferred that the game will include a marker, icon, chip, or button referred to herein as an extra-inning button 42. It is important to note that in a highly preferred embodiment of the invention the lead-off button 38, the base-runner button 40, and extra-inning button 42 are each of distinctively different size or of distinctively different proportions. This will allow individuals monitoring the game through the camera 16 to clearly identify and follow what the dealer 12 is doing. Alternatively, these different sized buttons serve as a means for the dealer 12 to communicate with individuals manning the camera 16.

It is contemplated that the game will be played with a standard 52 card deck of cards 30. The starting player will be indicated by the lead-off button 38, which will preferably be placed by the dealer 12 in front of the player 14 furthest to the left of the dealer 12 as the dealer faces the players 14. The lead-off button 38 may be moved by the dealer 12 in a clockwise direction from one play to the next by simply placing the button lead-off button 38 in front of the player 14 whose turn it is to start. It is important to note that the use of the lead off button allows the monitoring of the game by the camera 16 to ensure against the possibility of collusion between the players 14 and the dealer 12 to cheat the casino.

While it is contemplated that the lead-off player will be selected by his position relative to the dealer 12, it is contemplated that the lead-off player may be designated through a means for randomly selecting the player position to start the competition. This may include selecting the highest card or any other known means.

Also illustrated in FIGS. 2 and 4 is that the game surface also include means for collecting and storing 46 wagers. The means for collecting and storing 46 wagers should be positioned between the positions, or bounded areas 44 for placing and the dealer position 24. It is contemplated that these means for collecting and storing 46 wagers may be used to provide incentive for players to continue to play and regain some of the losses. For example, it is contemplated that a selected percentage, for example one percent of the game session's collected wagers may be put up as a special prize for a player who has an exceptionally good round or inning by drawing very hard to beat cards.

The versatility of the disclosed game device allow the playing of a variety of wagering games while being able to monitor the playing surface with minimal amount of personnel and with minimal surveillance equipment. Two examples of games are what will be referred to herein as "Grand-Slam Baseball" and "Grand-Slam Hold'em", described hereinbelow.

EXAMPLE 1

Grand-Slam Baseball

Players 12 of GRAND-SLAM game enter the game by placing an ante wager in the bounded area 44 labeled in the "batter-up" ante box, and a wager in the bounded area 44 labeled "strike-out". Preferably, the ante wager will be half of the strike-out wager. There must be at least two players before play can begin. GRAND-SLAM is played with a standard 52 card deck. There are no wild cards. The game begins with the dealer 12 placing the leadoff button 38 in front of the first player 14 to play, and then the dealer deals out five cards to each player in clockwise rotation, starting with the player with the lead-off button 38.

After all the cards have been dealt out, the dealer takes the next card and exposes it in the inning box 50. This will declare the trump suit for the inning of play and is left exposed for the entire inning. After the trump suit is determined for the inning, antes are collected by the dealer 12 and taken into the means for collecting and storing 46 wagers, which may also be referred to in the casino or gaming industry as the "pot".

Players 14 then study their cards and are then allowed to draw up to five new cards, starting with the player with the lead-off button 38. The play or competition between players then starts with the player with the lead-off button. A player may play any card in hand by laying it exposed in the player's card play-spot 53. Play goes in clockwise rotation around the table or surface 18 of the game, with each player playing one card per play. There are five plays in each inning, corresponding to the five cards originally in the player's hand. At the end of each play, the dealer awards the winner of that play a base-runner button 40 to indicate advancement to the next base in that player's player position 26. The dealer 12 then picks up the cards and discards them in-sequence of play in the discard rack.

The winner of a play must lead the next round of play until all five cards are played, the appropriate base-runners are awarded, and the inning is completed.

The dealer determines the winner of each inning by counting the number of base-runner buttons 40 in front of each player. The player 14 who has at least one base-runner button 40 more than any of the other players wins the collected ante wagers or pot. If two players tie for the most amount of base-runner buttons 40, the game of GRAND-SLAM BASEBALL goes into extra innings, which will be declared by the dealer 12 by placing the extra inning button 42 on the table so that it may be viewed by the surveillance camera. No new players may buy into an extra inning pot.

If there is a decisive winner rake, the sum of all wagers collected, is calculated and "dropped", and the winner is awarded the pot. If a player has no base-runners, the player's strike-out bet is taken into the new pot, and new players may buy into the game. If a game continues in extra innings, strike-outs are taken into the pot each time, and every player bets once again- ante and strike-outs. Extra innings may last as long as it takes for a decisive winner to be determined.

It is contemplated that an additional play may be incorporated into the game. The additional play is a progressive prize that awards a progressive jackpot to any decisive winner that shuts out all other players at the table. There must be four players at the table before the grand-slam pot becomes available. One percent of all awarded pots are added into the progressive, at the same time as the rake is calculated and dropped.

RULES OF PLAY FOR GRAND-SLAM BASEBALL

Play begins with the player with the lead-off button 38, until a player wins a base-runner button 40. The next play will begin with the winner of the last base-runner button 40, until the inning is complete. Players may play any cards they choose. The only suits that can win, however, are the trump suit and the lead suit. Base-runners are won at the end of each play by the player with the highest card in lead-off suit, or the highest trump card. If at the end of the play a player has been awarded a base-runner, that player's strike-out money is taken into the next pot. There must be a decisive winner of at least one base-runner more than any other player at the table, to win the pot. If there is a tie of base-runners the game of GRAND-SLAM BASEBALL goes into extra-innings. If a player strikes-out, the strike-out money is taken into the pot, as is the ante money of the next inning. This pot will grow until someone scores a decisive winner of one or more base-runners than any other player at the table. In a live pot of extra-innings players may drop out, but new players may not enter while the extra inning button is on the table, and until the extra-innings pot is cleared by a decisive winner. Players must play in turn. If a player plays a card out of turn, that player may not be eligible to win the base-runner. That runner is subsequently awarded to the next highest card. A player may play only one play spot per inning.

GLOSSARY OF TERMS FOR GAME OF GRAND-SLAM BASEBALL

1. ANTE; see batter-up, batter-up box.

2. BASE-RUNNER; the winner of a play has won a Single Base-Runner, a winner of two plays has won a Double, three plays a Triple, the winner of four has hit a Home run, and the winner of all five runs has hit a GRAND-SLAM against the other players.

3. BASE-RUNNER BUTTON; the Button placed before the spot of the winner of each play. They are cumulative, up to five.

4. BATTER-UP; initial wager to enter play in the game of GRAND-SLAM.

5. BATTER-UP BOX; the square in which the Batter-Up ante is placed.

6. DECISIVE WINNER; winner at the end of inning with at least one base-runner more than any other player at the table.

7. EXTRA-INNINGS; the roll-over of the pot when there is not a Decisive Winner; another inning of play with the pot rolled-over from the inning before.

8. EXTRA-INNING BUTTON; the Button placed on the table during Extra-Innings, to mark that Extra-Innings are being played, and no new players may enter the game.

9. INNING; each series of plays for five base-runners, the period during which a Trump rules, the period to determine the winner of pot, or Extra-Innings.

10. LEAD-OFF; the first player to get cards, to draw cards, and to play cards. After the first play of an Inning, the lead is the winner of the last play.

11. LEAD-OFF BUTTON; the Button placed before the Lead-Off player to mark the first and last player in the play. The Lead-Off Button moves in-rotation, Inning to Inning.

12. PLAY; the period in which a player plays one card, and can win one base-runner. There are five plays in an Inning.

13. PLAY-SPOT; the square in which a player plays his cards, one play at a time.

14. STRIKE-OUT; a wager placed at the beginning of each play with the Batter-Up, against the players winning no base-runners. If the player wins not a single base-runner, the Strike-Out is added to the next pot at the end of the play.

15. STRIKE-OUT BOX; the square in which the Strike-Out wager is placed, to insure the players not Striking-Out.

16. TRUMP SUIT; the card drawn after the player's first five cards have been dealt is the Trump card. It is left exposed in it's Box during the entire Inning.

17. TRUMP BOX; the square in which the Trump Suit card is left exposed during the entire Inning.

EXAMPLE 2

Grand-Slam Hold'em

1. Players place bets of ante and strike-out. Strike-out bet is twice the ante.

2. Antes are collected to the pot.

3. Players are dealt 2 cards, starting with the lead-off button position.

4. A 3 card flop is turned before any additional betting is done.

5. Starting with the lead-off button position, players may bet, check, raise, or fold, as state rules apply.

6. The turn card is turned, and players may bet, check, raise, or muck.

7. The river card is turned, and players may bet, check, raise, or muck.

8. The winner of the pot receives a base-runner button. In case of a tie, neither player wins a button, and the pot is split.

9. The lead-off button is moved in clockwise rotation to the next position, and strike-outs are collected into the Grand-Slam pot. All players that do not win the pot lose their strike-out bets to the Grand-Slam pot.

10. The first player to win 5 base-runner buttons wins the Grand-Slam pot.

11. All poker rules of Hold'em apply to the Grand-Slam Hold'em format.

12. Additional progressive jackpot: Any player who loses with a hand of at least full house, aces full of jacks (Three Aces and two Jacks) or better will be awarded the Grand-Slam Hold'em progressive. The prize is one percent of all awarded pots are taken into the progressive at the same time rake is calculated and dropped.

Thus it can be appreciated that the above described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood by that the foregoing and other modifications are exemplary only, and that equivalent changes in form and detail may be made without departing from the true spirit and scope of the invention as claimed, except as precluded by the prior art.

What is claimed is:

1. A wagering game for play between several players, an object of the game being player advancement along a sequence of locations or bases, the game being proctored by a single dealer who does not participate in the wagering, the game comprising:

a dealer position;

at least two player positions having:

a series of sequential base positions;

means for marking the sequential base advancement of the player at that player position; and at least one means for placing a bet, the means for placing a bet being positioned between the dealer position and the player position, so that the dealer can monitor and conduct a game amongst several players.

2. A wagering game according to claim 1 and further comprising contrasting indicia between the player positions.

3. A wagering game according to claim 1 wherein said at least one means for placing a bet comprises a pair of areas bounded by contrasting indicia.

4. A wagering game according to claim 1 wherein said means for allowing and marking the advancement of the player comprises four bases arranged in a baseball diamond configuration.

5. A wagering game device for allowing competition and wagering between at least three players while the competition is monitored by a dealer, the game device comprising:

a surface having opposing sides, the surface having a dealer position on one side and at least three player positions on the side opposite to the dealer position, each player position having:

a set of bases arranged in a baseball diamond configuration;

means for accumulating a progressive pot:

means for marking the position of a player at a base;

at least two means for placing a bet corresponding to each player position, the means for placing a bet being positioned between the dealer positions and each player position, so that wagering between players at the player positions competing for advancement about the respective bases at the player positions is carried out as the competition is controlled by the dealer on the opposing side from the players, and so that a progressive pot is accumulated by diversion of a portion of the wager by the dealer into the means for accumulating a progressive pot after a round.

6. A game device according to claim 5 and further comprising means for determining a starting player.

7. A game device according to claim 5 and further comprising means for indicating the base position of each player on the respective diamond at each player position.

8. A game device according to claim 5 and further comprising means for randomly selecting the player position to start the competition.

9. A game device according to claim 5 wherein said means for accumulating a progressive not comprises means for collecting and storing wagers, said means for collecting and storing wagers being positioned between the at least two positions for placing a bet of the player positions and the dealer position.

10. A game device according to claim 5 and further comprising a card means for allowing players to play one another.

11. A method of wagering while simulating a baseball game amongst several players while being proctored by a dealer, the method comprising:

providing a playing surface having at least three player positions, each player position having a set of bases arranged in a baseball diamond configuration, the playing surface further having a dealer position and wager placement positions between the set of bases and the dealer position;

providing means for allowing the dealer to establish the starting player;

placing player wagers on the wager placement positions;

collecting by means of the dealer the wagers placed in the wager placement positions;

selecting a set of rules for determining individual player advancement from base to base in each diamond; and awarding a portion of the wagers collected from the wager placement positions to the player who advances the most bases.

12. A method according to claim 11 wherein said wager placement positions comprise a pair of positions, the method further comprises designating one wager position as an ante position and the other position as a strikeout wager, and the step of collecting further comprises setting a set of rules for collecting and distributing wagers in the ante positions and setting a set of rules for collecting and distributing wagers the strikeout wager position.

13. A method according to claim 11 and further comprising providing contrasting indicia between the separate player positions, and monitoring the position of players relative to the contrasting indicia.

14. A method according to claim 11 wherein said step of selecting a set of rules for determining individual player advancement from base to base in each diamond comprises establishing a hierarchy of wining cards in a deck of playing cards and allowing a player to advance from a base to a succeeding base in accordance to that players possession of a wining card in the hierarchy of wining cards.

* * * * *